US006493970B1

(12) United States Patent
McCarthy et al.

(10) Patent No.: US 6,493,970 B1
(45) Date of Patent: Dec. 17, 2002

(54) SOCIAL EXPRESSION CARD WITH DETACHABLE GIFT PORTION

(75) Inventors: Mary K. McCarthy, Columbus, GA (US); Vickie Portwood Kruger, Columbus, GA (US); David A. Reynolds, Columbus, GA (US); Shere Lynne Anderson, Columbus, GA (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 09/525,414

(22) Filed: Mar. 15, 2000

(51) Int. Cl.[7] ..... G09F 1/04

(52) U.S. Cl. ..... 40/124.01; 229/70; 229/92.8; 283/116

(58) Field of Search ..... 40/124.01, 124.06, 40/124.09, 124.11, 124.12, 539, 725, 672, 773; 283/116, 117; 229/70, 76, 80, 72, 92.8

(56) References Cited

U.S. PATENT DOCUMENTS

| | | | | | |
|---|---|---|---|---|---|
| 1,168,787 | A | * | 1/1916 | Cohn | 40/124.06 |
| 3,374,940 | A | * | 3/1968 | Allison | 229/70 |
| 4,108,350 | A | * | 8/1978 | Forbes, Jr. | 229/70 |
| 4,140,317 | A | * | 2/1979 | Ramney | 229/72 |
| 4,359,631 | A | | 11/1982 | Lockwood | 235/381 |
| 4,616,327 | A | | 10/1986 | Rosewarne | 364/518 |
| 4,699,532 | A | | 10/1987 | Smith | 400/104 |
| 4,809,837 | A | | 3/1989 | Hayashi | 194/205 |
| 5,029,099 | A | | 7/1991 | Goodman | 364/479 |
| 5,036,472 | A | | 7/1991 | Buckley | 364/479 |
| 5,038,293 | A | | 8/1991 | Goodman | 364/479 |
| 5,056,029 | A | | 10/1991 | Cannon | 364/468 |
| 5,119,293 | A | | 6/1992 | Hammond | 364/401 |
| 5,132,915 | A | | 7/1992 | Goodman | 364/479 |
| 5,135,157 | A | * | 8/1992 | Cruz | 40/124.09 |
| 5,235,519 | A | | 8/1993 | Miura | 364/479 |
| 5,243,174 | A | | 9/1993 | Veeneman | 235/381 |
| 5,251,251 | A | | 10/1993 | Barber | 379/67 |
| 5,269,084 | A | * | 12/1993 | Best et al. | 40/124.11 |
| 5,408,417 | A | | 4/1995 | Wilder | 364/479 |
| 5,442,567 | A | | 8/1995 | Small | 364/479 |
| 5,477,037 | A | | 12/1995 | Berger | 235/379 |
| 5,500,514 | A | | 3/1996 | Veeneman | 235/381 |
| 5,513,117 | A | | 4/1996 | Small | 364/479 |
| 5,546,316 | A | | 8/1996 | Buckley | 364/479.03 |
| 5,552,994 | A | | 9/1996 | Cannon | 364/468.01 |
| 5,555,496 | A | | 9/1996 | Tackbary | 364/401 |
| 5,559,714 | A | | 9/1996 | Banks | 364/479.03 |
| 5,561,604 | A | | 10/1996 | Buckley | 364/479.05 |
| 5,600,563 | A | | 2/1997 | Cannon | 364/468.24 |
| 5,615,123 | A | | 3/1997 | Davidson | 364/479.03 |
| 5,687,087 | A | | 11/1997 | Taggart | 364/479.03 |
| H1708 | H | | 2/1998 | Davidson | 364/479.01 |
| 5,748,484 | A | | 5/1998 | Cannon | 364/479.03 |
| 5,751,590 | A | | 5/1998 | Cannon | 364/479.03 |
| 5,870,718 | A | | 2/1999 | Spector | 705/26 |
| 5,927,495 | A | * | 7/1999 | Didiano, Jr. | 229/92.8 |
| 6,053,536 | A | * | 4/2000 | Clevenstine | 283/116 |
| 6,192,608 | B1 | * | 2/2001 | Williams | 40/124.11 |
| 6,223,977 | B1 | * | 5/2001 | Hill | 229/70 |
| 6,237,844 | B1 | * | 5/2001 | Purcell | 229/70 |
| 6,269,158 | B1 | * | 7/2001 | Kim | 229/92.8 |

* cited by examiner

*Primary Examiner*—Anthony Knight
*Assistant Examiner*—Doug Hutton
(74) *Attorney, Agent, or Firm*—Pillsbury Winthrop, LLP

(57) ABSTRACT

A social expression card with a detachable gift portion includes a first panel and a second panel connected by a fold line to the first panel. The second panel is foldable over said first panel to form a card. A third panel, which includes a detachable gift portion, is connected by a fold line to the second panel. The third panel is foldable over the second panel to a position in which the detachable portion is hidden between the first and second panels when the second panel is folded over the first panel. The detachable portion includes gift indicia. Examples of gift indicia include gift certificates, photographic images, and the like.

12 Claims, 4 Drawing Sheets

SOCIAL EXPRESSION CARD WITH DETACHABLE GIFT PORTION

CROSS-REFERENCE TO RELATED APPLICATION

The present application is related to application Ser. No. 09/378,678, filed Aug. 20, 1999, titled METHOD OF AND SYSTEM FOR DELIVERING COMBINED SOCIAL EXPRESSION CARDS AND GIFT CERTIFICATES, the disclosure of which in incorporated herein by reference.

FIELD OF THE INVENTION

The present invention relates generally to the field of social expression cards, and more particularly to a social expression card with a detachable gift portion.

DESCRIPTION OF THE PRIOR ART

People like to commemorate important events in people's lives, such as weddings, anniversaries, and birthdays, and show their appreciation and affection for others by sending gifts and social expression cards, such as greeting cards. Most greeting cards sent today are mass produced cards purchased in retail establishments such as card shops, gift shops, grocery stores and the like. Gifts, of course, may be purchased at any of a number of retail establishments.

It is not always easy to find a mass produced card that expresses the right sentiment. Additionally, there is a desire on the part of most people to personalize their gifts and greeting cards. Most people write a personal greeting in the mass produced cards that they send to others. Recently, there have been introduced card vending machines or kiosks that enable purchasers to create personalized printed social expression cards. Also, there are software packages that enable people to produce cards using personal computers.

In the area of gifts, most people prefer to give a gift that they believe will be meaningful to and appreciated by the recipient. However, a giver may know only generally the wants and needs of a particular recipient. For example, the giver may know that an intended recipient likes music or a particular style of clothing. However, the giver may not know which musical group the recipient likes or whether the recipient would prefer one article of clothing over another. In such instances, the gift certificate from a store that carries goods of the type appreciated by the recipient might be an appropriate gift.

The traditional method of purchasing requires that a person visit one or more retail establishments. Most people like to send a card with a gift. Accordingly, purchasing a gift may require travel to one or more card shops as well as one or more gift or other retail stores in order to find the right combination of a card and gift. In today's busy world, many people find it difficult to find the time to shop for cards and gifts.

In addition to cards commemorating events such as weddings, anniversaries, and birthdays, many people send holiday greetings to their friends, family members, and business contacts. One popular form of holiday greeting includes a photograph of the sender's family or children, or of some other thing of importance, such as the family home or pet. While the photograph may simply be enclosed in a conventional holiday greeting, many people like to have the photograph printed as part of the card.

In addition to holiday greeting, many businesses send cards to their clients and customers. These business-type cards may be for the purpose of making an announcement or simply to remind the recipient of the existence or presence of the business. It is fairly common to include a business card or "Rolodex" card with these business-related cards and announcements.

SUMMARY OF THE INVENTION

The present invention provides a social expression card with a detachable gift portion. The card of the present invention includes a first panel that is preferably square or rectangular in shape. A second panel of substantially the same size and shape is connected by a fold line to the first panel. The second panel is foldable over said first panel to form a card. A third panel, which includes a detachable gift portion, is connected by a fold line to the second panel. The third panel is foldable over the second panel to a position in which the detachable portion is hidden between the first and second panels when the second panel is folded over the first panel.

The detachable portion is sized so that it may be carried in a recipient's wallet, pocketbook, purse, or the like. The detachable portion includes gift indicia. In one embodiment, the gift indicia is a gift certificate. In another embodiment, the gift indicia is a photographic image. The photographic image may be a miniature of a photographic image carried by the first panel. The gift indicia may also comprise a business card, coupon, or other writing or image.

The card of the present invention may be adapted for mailing in a conventional envelope. Alternatively, the card may be in the form of a self-mailer. In the self-mailer embodiment, a sealing flap is connected by a fold line to the first panel. The first panel includes recipient mailing address indicia and the sealing flap includes sender return address indicia.

DESCRIPTION OF THE PREFERRED EMBODIMENT

Figure 1:
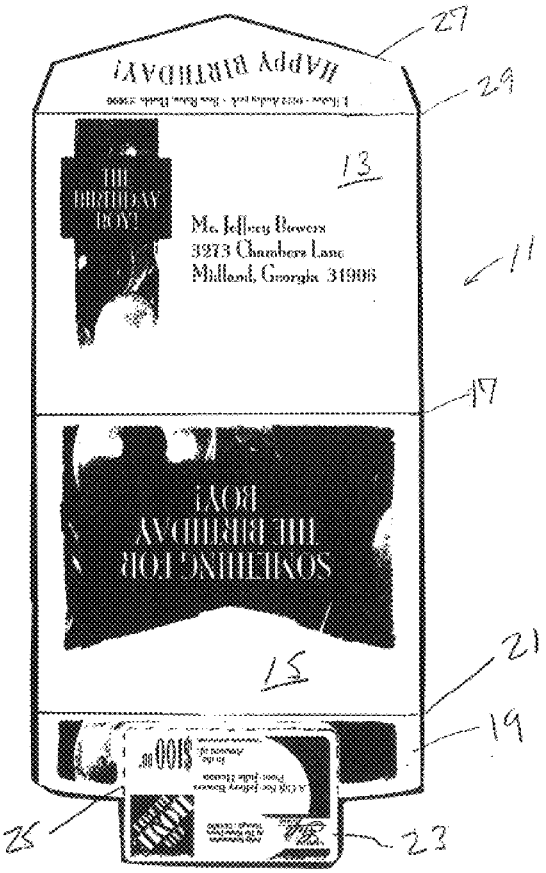
FIG. 1 is a view of the back side of a combined social expression card and gift certificate according to one embodiment of the present invention.
Figure 2:
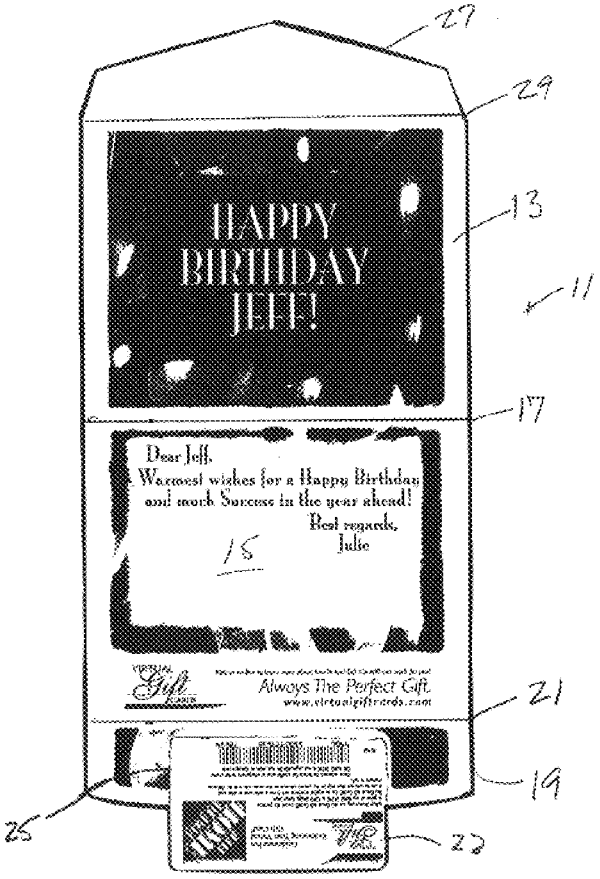
FIG. 2 is a view of the front side of the combined social expression card and gift certificate of FIG. 1.

Referring now to the drawings, and first to FIGS. 1–5, a self-mailer embodiment of the social expression card with detachable gift portion of the present invention is designated generally by the numeral 11. Gift card 11 is printed on-both sides of a single sheet of cardstock. FIG. 1 illustrates the back side of card 11 and FIG. 2 illustrates the front side of card 11. Preferably, cards are printed two at a time on a large piece of cardstock and then die-cut into the cards illustrated in the figures.

Card 11 includes a first panel 13 and a second panel 15. First panel 13 and second panel 15 are preferably rectangular or square and are of substantially the same dimensions. First panel 13 and second panel 15 are connected together by a fold line 17. The back side of first panel 13, as illustrated in FIG. 1, is printed with the recipient's name and mailing address. The front side of panel 13, as illustrated in FIG. 2, is printed with an appropriate greeting, preferably selected by the sender of the card. The back side of second panel 15 is printed with a decorative greeting and the front side of second panel 15 is printed with a greeting message. The term greeting is used herein in the broad sense to include not only social expressions and sentiments, but also any. messages such as business announcements, address changes, invitations, and the like.

A third panel 19 is connected to second panel 15 by a fold line 21. Third panel 19 includes a detachable gift portion 23, which in the embodiment of card 11 comprises a gift certificate card. Detachable portion 23 is separable from third panel 19 by die-cut perforations 25. Preferably, detachable portion 23 is wallet-sized so that it may be conveniently carried in a wallet, pocketbook, purse, or the like when it is detached from card 11. The back side of detachable portion 23, as illustrated in FIG. 1, is printed with gift indicia. The front side of detachable portion 23, as illustrated in FIG. 2, is printed with further gift indicia.

A sealing flap 27 is connected to first panel 13 by a fold line 29. The back side of sealing flap 27, as illustrated in FIG. 1, is printed with the sender's return address. The front side of sealing flap 27 is coated with an adhesive. As will be explained in connection with FIGS. 4 and 5, card 11 is foldable along fold lines 17, 21, and 29, to form a self mailer.

Figure 3:
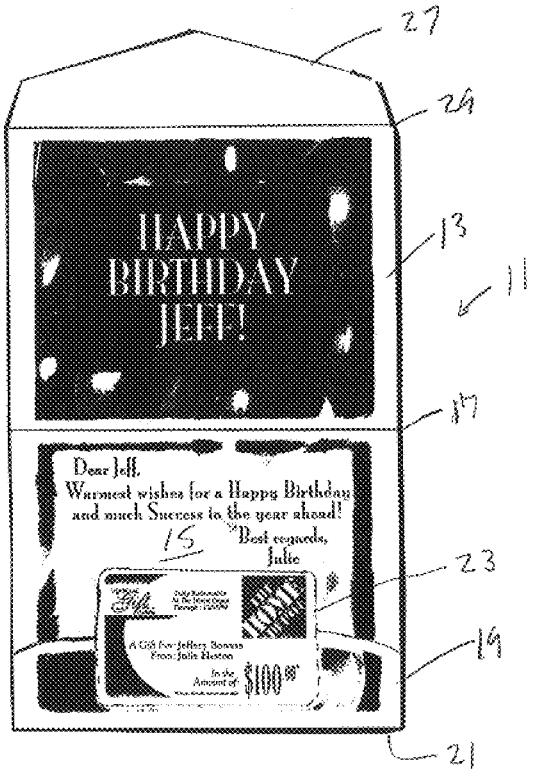
FIG. 3 is a view of a partially folded combined social expression card and gift certificate of FIGS. 1 and 2.

Referring now to FIG. 3, there is illustrated the front side of card 11 with third panel 19 folded along fold line 21 to cover partially second panel 15. As shown in FIG. 3, the greeting message of second panel 15 is visible above detachable portion 23. First panel 13 is foldable along fold line 17 to cover second panel 15 and folded over third panel 19. First panel 13 and second panel 15 when folded along fold line 17 conceal third panel 19, including detachable portion 23. Then, sealing flap 27 is foldable along fold line 29 to form a self mailer, as illustrated in FIGS. 4 and 5.

Figure 4:
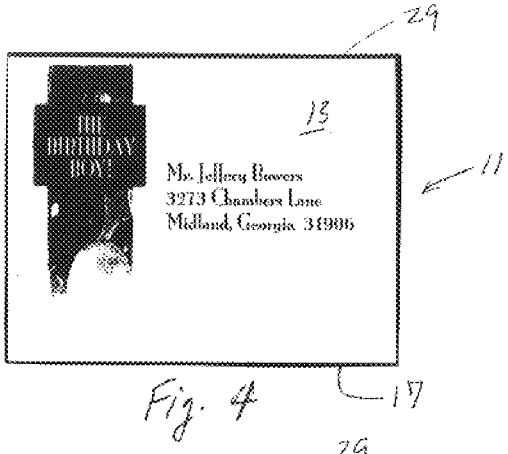
FIG. 4 is a view of the front side of the combined social expression card and gift certificate of FIGS. 1–3 folded for mailing according to the present invention.
Figure 5:
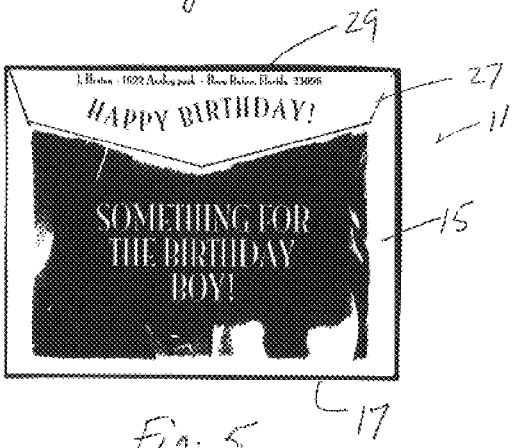
FIG. 5 is a view of the back side of the combined social expression card and gift certificate of FIGS. 1–4 folded for mailing according to the present invention.

After formation of the self-mailer of FIGS. 4 and 5, postage may be applied to first panel 13 so that the self-mailer may be delivered to the recipient. When the recipient receives the self-mailer, the recipient may unseal sealing flap 27 and open the card to the position of FIG. 3, thereby revealing detachable gift portion 23. The recipient may remove detachable gift portion 23 and take the gift certificate to the appropriate establishment for redemption.

The self-mailer embodiment of the present invention, as illustrated in FIGS. 1–5 is preferably produced with user-selectable or created sentiments, designs, and gift certificate according to the disclosure of application Ser. No. 09/378,678, filed Aug. 20, 1999, titled METHOD OF AND SYSTEM FOR DELIVERING COMBINED SOCIAL EXPRESSION CARDS AND GIFT CERTIFICATES, which is incorporated herein by reference, remotely using the Internet as a user interface. The self-mailer embodiment may also be produced locally at a self-service kiosk or retail location. The card of the present invention is preferably printed using digital printing technology so that as few as one card with the selected sentiment, design, and gift may be produced.

Figure 6:
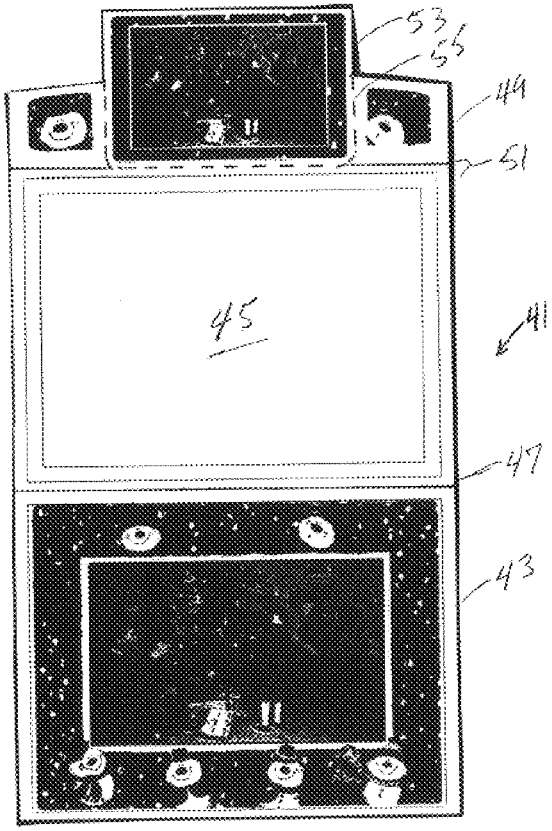
FIG. 6 is a view of the back side of a combined social expression and photo gift card according to an alternative embodiment of the present invention.
Figure 7:
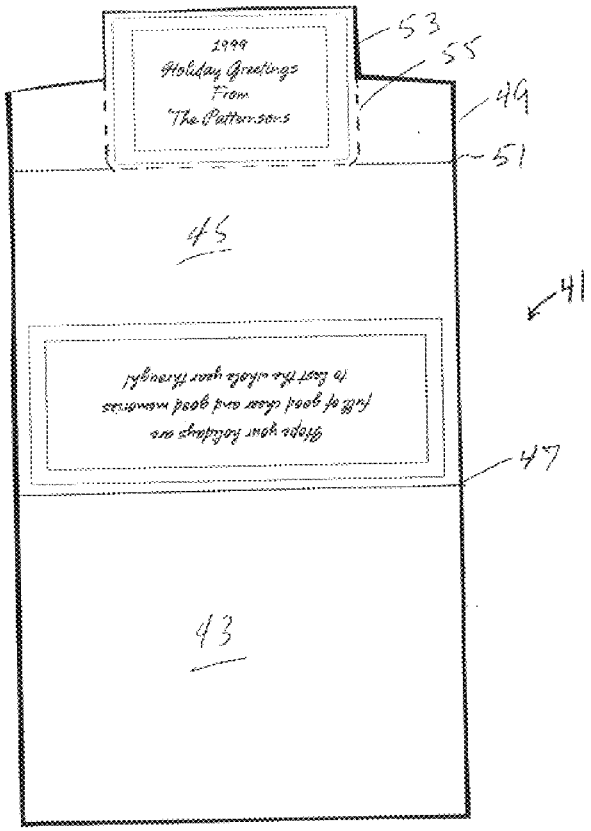
FIG. 7 is a view of the front side of the combined social expression and photo gift card of FIG. 6.

Referring now to FIGS. 6–9, there is illustrated an alternative embodiment of the social expression card and a detachable gift portion of the present invention. The card of the alternative embodiment is designated generally by the numeral 41. Again, card 41 is printed on both sides of a single sheet of card stock. FIG. 6 illustrates the back side of card 41 and FIG. 7 illustrates the front side of card 41.

Card 41 includes a first panel 43 and a second panel 45. As in the embodiment of FIGS. 1–5, first panel 43 and second panel 45 are rectangular or square of substantially the same dimensions. First panel 43 and second panel 45 are connected together by a fold line 47. The back side of second panel 43, may be substantially blank, as illustrated in FIG. 6, or it may be printed with manufacturing, copyright, or other information. The front side of second panel 45, as illustrated in FIG. 7, is printed with an appropriate greeting, again preferably selected by the sender of the card.

The card of the embodiment of FIGS. 6–9 is a Christmas holiday greeting. The back side of first panel 43, as illustrated in FIG. 6, is printed with a user provided photographic image and an appropriate decorative border. The photographic image is preferably provided in a digital format for sizing, cropping, and printing. The image may also be non-photographic in nature, such as scanned-in piece of artwork or the like. The front side of first panel 43 is preferably left blank.

A third panel 49 is connected to second panel 45 by a fold line 51. Third panel 49 includes a detachable gift portion 53, which in the embodiment of card 41 comprises a miniature of the photographic image of first panel 43, as illustrated in FIG. 6, although third panel 49 may contain other indicia according to the sender's desires. The side of detachable portion 53 illustrated in FIG. 7 bears an appropriate users-selected or user-provided greeting. Detachable portion 53 is separable from third panel 49 by die-cut perforations 55. Preferably, detachable portion 53 is wallet-sized so that it may be conveniently carried in a wallet, pocketbook, purse, or the like when it is detached from card 41. The detachable portion 53 may contain other gift indicia than an image. For example, the gift indicia may comprise a verse of scripture or other inspirational writing.

Figure 8:
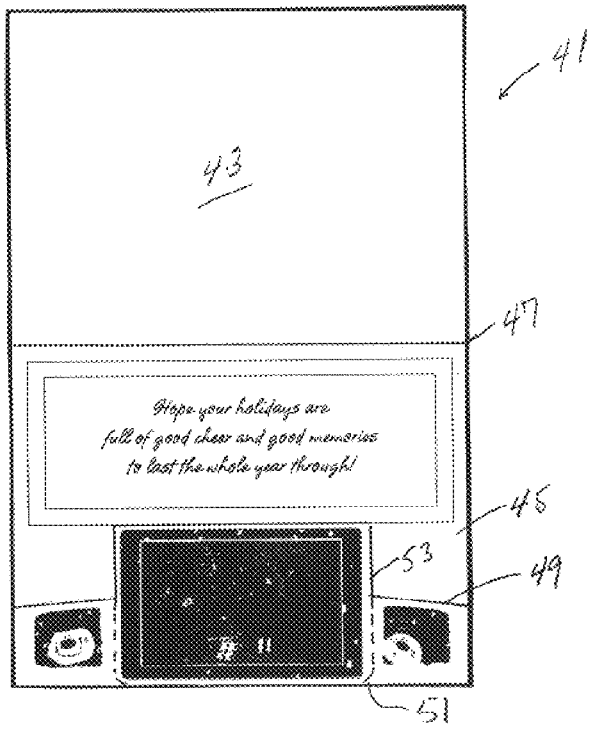
FIG. 8 is a view of a partially folded combined social expression and photo gift card of FIGS. 6 and 7.
Figure 9:
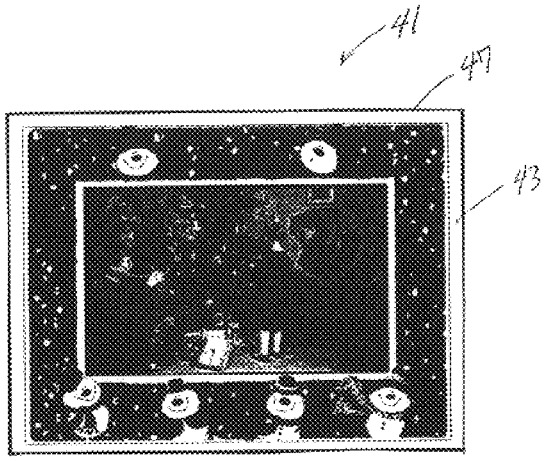
FIG. 9 is a view of the fully folded combined social expression card and photo gift card of FIGS. 6–8.

Referring now to FIG. 8, there is illustrated the front side of card 41 with third panel 49 folded along fold line 51 to cover second panel 15 partially. As shown in FIG. 8, the greeting message of second panel 45 is visible above detachable portion 53. First panel 43 is foldable along fold line 47 to cover second panel 45 and folded over third panel 49 to from the card illustrated in FIG. 9. First panel 43 and second panel 45, when folded along fold line 47, conceal third panel 49, including detachable portion 53.

The card of FIGS. 6–9 is adapted to be delivered to a recipient in a conventional envelope (not shown). When the recipient receives the envelope and removes card 41, the recipient may open the card to the position of FIG. 8, thereby revealing the miniature photographic image of detachable gift portion 53. The recipient may remove detachable gift portion 53 to carry the photographic image in his or her wallet or purse as a keepsake.

In the embodiment of FIGS. 6–9, the image of detachable portion 53 is a reduced version of the image of first panel 43. However, it should be recognized that the content of detachable portion 53 may be completely different from the content of first panel 43. For example, the content of panel 43 may be a business image or message and the content of detachable portion 53 may include a business card, "Rolodex" card, or other business related content. Also, it should be recognized that a card in which the detachable gift portion comprises a gift certificate may be embodied in a non-self-mailing card. Similarly, a card in which the detachable gift portion comprises a photographic image may be embodied in a self-mailing card.

The present invention has been illustrated and described with reference to presently preferred embodiments. Those skilled in the art will recognize alternative embodiments, given the benefit of the foregoing disclosure. Accordingly, the foregoing disclosure is intended for purposes to illustration rather than limitation.

What is claimed is:

1. A card structure, which comprises:

a first panel;

a second panel connected by a fold line to said first panel, said second panel having substantially the same dimensions as said first panel, said first panel being selectively foldable over said second panel to form a card, said first panel including a first image that is exposed when said first panel is folded over said second panel; and, a third panel connected by a fold line to said second panel, said third panel being selectively foldable over said second panel to a position hidden between said first and second panels when said first panel is folded over said second panel, said third panel including a detachable portion, said detachable portion including a second image that is exposed when said third panel is folded over said second panel and said first panel is unfolded from said second panel, said second image being a miniature of said first image.

2. The card structure as claimed in claim 1, including:

a sealing flap connected to said first panel along a fold line, said sealing flap being foldable over said second panel when said first panel is folded over said second panel.

3. The card structure as claimed in claim 1, wherein said third panel is sized to expose a portion of said second panel when said third panel is folded over said second panel.

4. The card structure as claimed in claim 3, wherein said second panel includes a greeting in said exposed portion of said second panel.

5. The card structure as claimed in claim 1, wherein said detachable portion is wallet-sized.

6. A method of producing a social expression card, which comprises the steps of:

forming a card structure, said card structure including:

a first panel;

a second panel connected by a fold line to said first panel, said second panel having substantially the same dimensions as said first panel; said first panel being selectively foldable over said second panel;

a third panel connected by a fold line to said second panel, said third panel including a detachable portion; printing indicia including a first photographic image on said first panel;

and printing gift indicia on at least one surface of said detachable portion, said gift indicia including a second photographic image, said second photographic image including a miniature of said first photographic image.

7. The method as claimed in claim 6, including the steps of:

folding said third panel over said second panel; and, folding said first panel over said second panel and said folded over third panel.

8. The method as claimed in claim 7, wherein said card structure includes a sealing flap connected by a fold line to said first panel and said method includes the step:

folding said sealing flap over said second panel after said step of folding said first panel over said second panel.

9. The method as claimed in claim 8, including the step of printing recipient address indicia on said second panel.

10. The method as claimed in claim 8, including the step of printing sender return address indicia on said sealing flap.

11. The method as claimed in claim 8, including the step of sealing said folded over sealing flap to said second panel.

12. The method as claimed in claim 6, including the step of printing a greeting on said second panel.

* * * * *